US006384924B1

(12) United States Patent
Lee

(10) Patent No.: US 6,384,924 B1
(45) Date of Patent: May 7, 2002

(54) METHOD FOR REMOVING POLLUTION MATERIAL WHICH REMAIN ON AN ENGINE OF AN IMAGE FORMING APPARATUS

(75) Inventor: Bong-Gi Lee, Kyonggi-do (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/176,930

(22) Filed: Oct. 23, 1998

(30) Foreign Application Priority Data

Oct. 23, 1997 (KR) ..... 1997-54352

(51) Int. Cl.[7] ..... G06S 15/00
(52) U.S. Cl. ..... 358/1.14
(58) Field of Search ..... 358/1.14, 406, 358/504; 294/1.1; 399/18, 21

(56) References Cited

U.S. PATENT DOCUMENTS 5,270,773 A * 12/1993 Sklut ..... 355/201
5,573,291 A * 11/1996 Raupp ..... 294/1.1
5,758,916 A * 6/1998 Raupp ..... 294/1.1

FOREIGN PATENT DOCUMENTS

JP 408259041 A * 10/1996 ..... B65H/7/06

* cited by examiner

*Primary Examiner*—Jerome Grant, II
(74) *Attorney, Agent, or Firm*—Robert E. Bushnell, Esq.

(57) ABSTRACT

Disclosed is a method for removing contaminants which remain on an engine of an image forming apparatus, such that when a sheet of paper becomes jammed in the image forming apparatus during a printing operation, a subsequent sheet of paper is enforcedly supplied to the image forming apparatus after removing the jammed paper so that contaminants, for example toner, are removed from the image forming apparatus in such a manner to fix the contaminants to the subsequent sheet of paper. While fixing the contaminants to the subsequent sheet of paper, print data is not fixed onto the subsequent sheet of paper. Accordingly, an optimum quality of printing can be accomplished without a waste of toner.

23 Claims, 3 Drawing Sheets

METHOD FOR REMOVING POLLUTION MATERIAL WHICH REMAIN ON AN ENGINE OF AN IMAGE FORMING APPARATUS

CLAIM OF PRIORITY

This application makes reference to, incorporates the same herein, and claims all benefits accruing under 35 U.S.C. § 119 from an application entitled a Method for Removing Pollution Material Which Remain on an Engine of an Image Forming Apparatus earlier filed in the Korean Industrial Property Office on the day of Oct. 23$^{rd}$, 1997, and there duly assigned Ser. No. 54352/1997, a copy of which is annexed hereto.

BACKGROUND OF THE INVENTION

1. Technical Field

The present invention relates to a method for removing contamination from an image forming apparatus, and more particularly to a method for removing contamination from an engine of an image forming apparatus in order to maintain optimum quality of printing.

2. Related Art

In general, a printer is an image formation device which receives data from a host computer and then forms a corresponding image onto a recordable medium such as a sheet of paper.

In a laser printer, print data such as document data or image data are received from external equipment such as a host computer or a personal computer to develop the print data into printable bit image data. The developed bit image data are stored into a print image buffer. Then, a laser beam corresponding to bit image data of one raster read out from the print image buffer is emitted from a laser diode to perform a main scanning operation, thereby forming an electrostatic latent image on a photosensitive drum for every dot line. Thereafter, toner is attached to the electrostatic latent image on the photosensitive drum and then transferred onto a recordable medium such as a sheet of paper. The toner on the recordable medium is heated by a fixing heater of a fixing device to fix the toner on the recordable medium, thereby completing a print process.

As stated above, a printer is generally coupled to a computer system in order to receive data from the computer system. Computer systems are information handling systems that are utilized by many individuals and businesses today. A computer system can be defined as a microcomputer that includes a central processing unit (CPU), a volatile memory, a non-volatile memory, a display monitor, a keyboard, a mouse or other input device such as a trackball, a floppy diskette drive, a compact disc-read only memory (CD-ROM) drive, a modem, a hard disk storage device, and a printer. Typically, a computer system's main board, which is a printed circuit board known as a motherboard, is used to electrically connect these components together.

Typically, a laser printer includes a set of rollers able to feed the sheet of paper along a path while the toner is transferred onto the sheet of paper. Sometimes a paper jam occurs in the laser printer when the sheet of paper adheres improperly to a roller or when the sheet of paper is fed in an improper manner. After a paper jam occurs, the print operation must be halted or interrupted so that the jammed sheet of paper may be removed from the laser printer. Then the print operation may resume.

I have found that contaminants including excess toner can sometimes remain within the laser printer in inconvenient locations after the jammed sheet of paper has been removed from the laser printer. Because of these contaminants, an image formed on a subsequent sheet of paper fed into the laser printer can often be characterized by low quality.

SUMMARY OF THE INVENTION

The present invention has been made to overcome the above described problems. It is an object of the present invention to provide a method for removing pollution material which remain on an engine of an image forming apparatus. It is an additional object of the present invention to provide a method for removing pollution material which remain on an engine of an image forming apparatus, in which when a paper is jammed during a printing operation, the other paper following the jammed paper is enforcedly supplied to the image forming apparatus after removing the jammed paper so that the pollution material such as toner is removed from the image forming apparatus in such a manner to fix the pollution material to the other paper without printing data on the other paper.

To accomplish the above objects of the present invention, there is provided a method for removing pollution material which remain on an engine of an image forming apparatus, comprising the steps of: checking whether a paper is jammed during the operation of printing; determining whether the jammed paper is removed from a printer when the paper is jammed; and removing the pollution material from an engine in such a manner to fix the pollution material on an other paper which is enforcedly supplied to the engine.

When the paper is jammed, an alarm may be generated until the jammed paper is removed from the printer. The method according to the present invention further comprises the step of determining whether or not a cleaning mode is set before the step of removing the pollution material which remain on the engine. After the step of removing the pollution material which remain on the engine is carried out, it is carried out to print data to be printed on the jammed paper on the other paper again. The other paper to follow the jammed paper and to be enforcedly supplied to the engine is a blank paper. An operation of fixing the pollution material on the other paper only is carried out without printing data on the other paper to be supplied to the engine.

To achieve these and other objects in accordance with the principles of the present invention, as embodied and broadly described, the present invention provides a method comprising: determining whether a first recording medium is jammed in an image forming apparatus during a printing operation; when said first recording medium is jammed in said apparatus during said printing operation, determining whether said first recording medium is removed from said apparatus; and when said first recording medium is removed from said apparatus, supplying a second recording medium to said apparatus and transferring pollution material of said apparatus to said second recording medium and then ejecting said second recording medium from said apparatus.

To achieve these and other objects in accordance with the principles of the present invention, as embodied and broadly described, the present invention provides a method comprising: receiving a first recording medium into an image forming apparatus; performing a first printing operation to form a first image onto said first recording medium; determining whether said first recording medium is jammed in said apparatus; when said first recording medium is jammed in said apparatus, determining whether said first recording medium is removed from said apparatus; when said first recording medium is removed from said apparatus, receiving a second recording medium into said apparatus, transferring pollution material of said apparatus to said second recording medium, and then ejecting said second medium and said pollution material from said apparatus; receiving a third recording medium into said apparatus; and performing a second printing operation to form said first image onto said third recording medium, and then ejecting said third recording medium.

To achieve these and other objects in accordance with the principles of the present invention, as embodied and broadly described, the present invention provides a method comprising: determining whether a first recording medium is jammed in an image forming apparatus during a first printing operation; when said first recording medium is jammed in said apparatus during said first printing operation, determining whether said first recording medium is removed from said apparatus; when said first recording medium is removed from said apparatus, performing a pollution removal operation by supplying a second recording medium to said apparatus and transferring pollution material from a first location in said apparatus to said second recording medium and then removing said second medium and said pollution material from said apparatus; and said pollution material corresponding to a material remaining at said first location after the jammed first recording medium is removed from said apparatus, wherein said pollution material located at said first location will cause a degradation in a quality of a second printing operation unless said pollution material is removed from said first location prior to performing said second printing operation.

The present invention is more specifically described in the following paragraphs by reference to the drawings attached only by way of example. Other advantages and features will become apparent from the following description and from the claims.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DESCRIPTION OF THE PREFERRED EMBODIMENT

Figure 1:
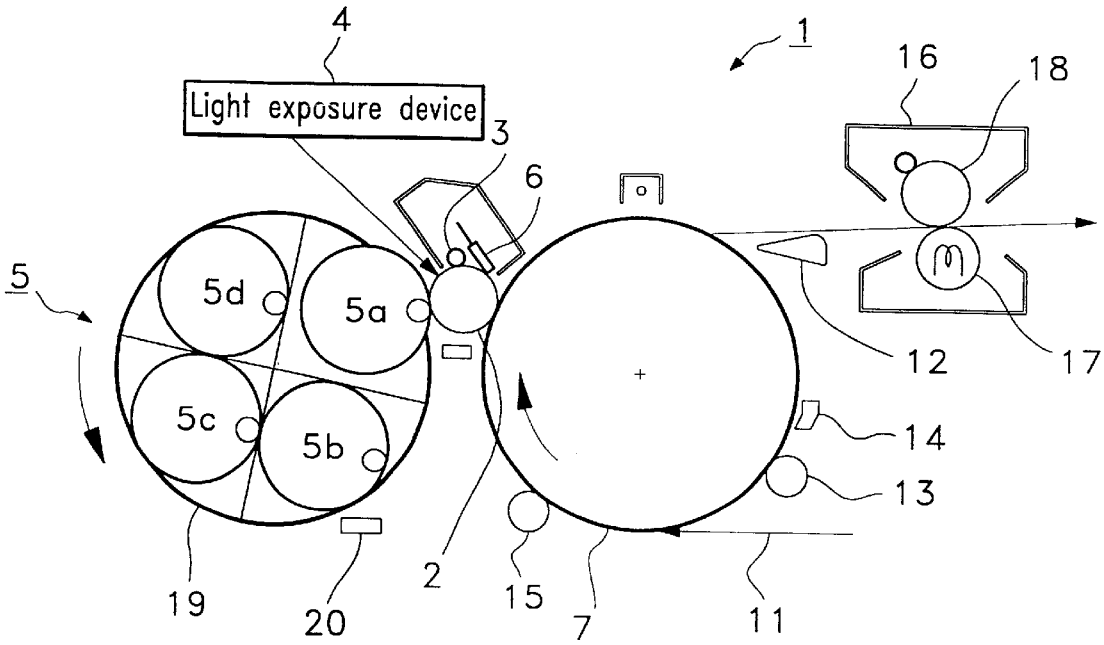
FIG. 1 is a schematic view of a printer engine mounted in a color printer to which a method for removing pollution material which remain on the printer engine is applied, in accordance with the principles of the present invention.

An image forming device, such as a printer, a copier, or a combined office automatic instrument, can utilize a way of developing an electrophotography and can include an electrification roller which electrifies a photosensitive material coated on a peripheral surface of a photosensitive device under a high voltage while rotating. An electrostatic latent image is formed on the photosensitive material which is electrified by the electrification roller by a light signal outputted from a light exposure device, for example a laser diode, which converts the digital signal into a laser light.

The electrostatic latent image which is formed on the photosensitive device is developed by a toner while passing through a developing device to be presented as a visible image. The visible image is transmitted to and formed on a recording paper carried by a pick-up roller. The process of printing the data on the recording paper is repeatedly carried out to be corresponding to different colors. If an operation of forming the image is completed with respect to the colors, the colorful image which is transmitted on the recording paper is fixed to the recording paper under a heat and a pressure by a fixing device and then the recording paper is discharged from the printer.

When an electric power is supplied to the image forming apparatus, the apparatus carries out warming-up for a predetermined amount of time according to characteristics thereof. When the apparatus completes the warming-up, the apparatus is then in a state ready to perform a printing operation. When the apparatus is in a state ready to perform a printing operation and an instruction to perform a printing operation is not transmitted to the apparatus in predetermined amount of time, then apparatus goes into a stand-by state.

The image forming apparatus generally is divided into three regions as follows. The first region corresponds to a position at which the recording paper is placed into a paper supplying section for supplying the paper on which data is to be printed. The second region corresponds to a developing section for forming a desired image by coating the supplied paper with developer. The third region corresponds to a paper discharging section for discharging the developed paper out of the apparatus.

The operation of the image forming apparatus will be described below. While the paper is supplied from the paper supplying section and carried to the developing section and then to the paper discharging section, the operation of forming an image is performed. When the paper becomes jammed during the carrying of the paper, however, a controller alerts that the paper is jammed in the printer engine. Then, when a user removes the jammed paper from the printer, or when the jammed paper is automatically removed from the printer, the controller performs the warming-up of the apparatus and prints data to be printed on a new sheet of recording paper.

In an image forming apparatus, when the paper is jammed during the operation of printing the data on the paper, the operation of printing the data on a new sheet of paper is carried out again after the jammed paper is removed from the image forming apparatus by itself or by a user and the warming-up of the apparatus is completed.

In the case as described above, pollution material or contaminants, for example a toner on the developing device, the fixing device, or the photosensitive device, remains in the printer engine due to the jam of the paper. Accordingly, there is a disadvantage in that the new sheet of paper can be polluted by the toner, whereby the quality of the printing can be degraded.

Hereinafter, a method for removing pollution material which remains on an engine of an image forming apparatus according to a preferred embodiment of the present invention will be described in detail with reference to the accompanying drawings.

Turn now to FIG. 1, which is a schematic view of a printer engine mounted in a color printer to which a method for removing pollution material which remain on the printer engine is applied, in accordance with the principles of the present invention. The printer engine 1 as shown in FIG. 1 is provided with a photosensitive device 2 having a conductive surface coated with a photosensitive material and a rotary body (not shown) supporting the printer engine 1. The photosensitive device 2 is driven by a driving device (not shown).

Furthermore, around the photosensitive device 2, it is possible to dispose an electrifying device 3 for electrifying the surface of the photosensitive device 2 in a predetermined electric potential, a light emitting device 4 for forming an electrostatic latent image on the surface of the photosensitive device 2, such as a laser diode, a developing device 5 which rotates to be in contact with the photosensitive device 2 under a predetermined pressure, for forming toner images of 4 colors on the electrostatic latent image formed on the surface of the photosensitive device 2 repeatedly, and a first cleaning device 6 for removing toner which remains on the surface of the photosensitive device 2.

Figure 2:
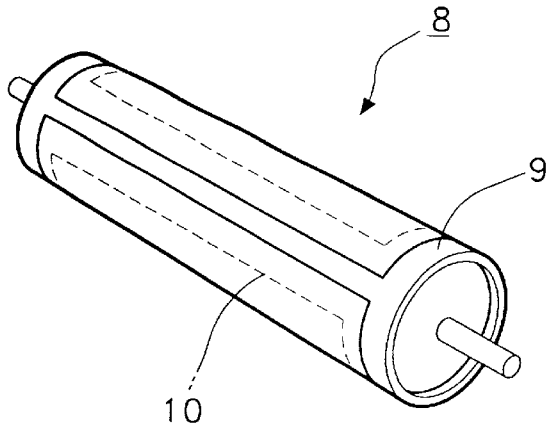
FIG. 2 is a perspective view of an image transmitting device in FIG. 1, in accordance with the principles of the present invention.

With continued reference to FIG. 1, turn now to FIG. 2, which is a perspective view of an image transmitting device in FIG. 1, in accordance with the principles of the present invention. The image transmitting device 7 of FIG. 1 includes an image transmitting drum 8 of FIG. 2 supported by a rotary body. The image transmitting drum 8 rotates in contact with the photosensitive device 2 under the predetermined pressure. As shown in FIG. 2, the image transmitting drum 8, which is mounted in the image transmitting device 7, has an image transmitting cylinder 9. The image transmitting cylinder 9 has a surface which is covered with a dielectric sheet 10 made of a polyethylene terephthalate (PET) and polyvinylidene fluoride (PVDF).

A sheet of paper 11 serves as a recording medium and is electrostatically or mechanically attached to the surface of the image transmitting device 7. Furthermore, an electrification voltage is applied to the image transmitting cylinder 9 of the image transmitting device 7 so that the toner image formed on the photosensitive body of the photosensitive device 2 is transmitted to the recording paper 11.

A paper sorter 12 is mounted at a position adjacent to an upper portion of the image transmitting device 7. When finishing the transmission of image, a leading edge of the paper sorter 12 comes in contact with the surface of the image transmitting device 7 to separate the recording paper 11 from the image transmitting device 7. A device for removing charges 13 is mounted to be in contact with the image transmitting device 7 so as to remove charges from the image transmitting device 7 when the transmission of image is completed.

A second cleaning device 14 is mounted at a position adjacent to the image transmitting device 7 so as to clean the surface of the image transmitting device 7 after finishing the transmission of the image. An electrification roller 15 is mounted to be in contact with the image transmitting device 7. The recording paper 11 is carried by the image transmitting device 7 while being in close contact with the image transmitting device 7 as the electrification voltage is supplied to the electrification roller 15. The toner image is fixed to the recording paper 11 separated from the image transmitting device 7 while passing between a heating roller 17 and a compressive roller 18 of a fixing device 16.

In FIG. 1, the developing device 5 in a form of a rotary turret has four containers 5*a*, 5*b*, 5*c*, and 5*d*. Each of the four containers has a different type of toner. There is a container 5*a* for cyan toner, a container 5*b* for yellow toner, a container 5*c* for magenta toner, and a container 5*d* for black toner. There is a cylindrical support 19 which is supported by a rotary body (not shown) for receiving the four containers 5*a*, 5*b*, 5*c*, and 5*d*.

The developing device 5 in the form of the rotary turret rotates in a direction so that the containers 5*a*, 5*b*, 5*c*, and 5*d* are moved to a position to be opposite to the surface of the photosensitive device 2. At the same time, the electrostatic latent image is formed on the surface of the photosensitive device 2 so that the four colors are developed on the electrostatic latent image during a rotation of the support 19.

Also, a detector 20 for detecting a remainder of the toners which remains in respective container 5*a*, 5*b*, 5*c*, and 5*d* of the developing device 5 is mounted at a lower portion of the developing device 5. The detector 20 includes a light emitting element for emitting light to the developing device 5 at a predetermined angle, a light receiving element for receiving light reflected by the developing device 5 and for converting the light into an electrical signal corresponding to the light, and a holder for supporting the light emitting and receiving elements.

Figure 3:
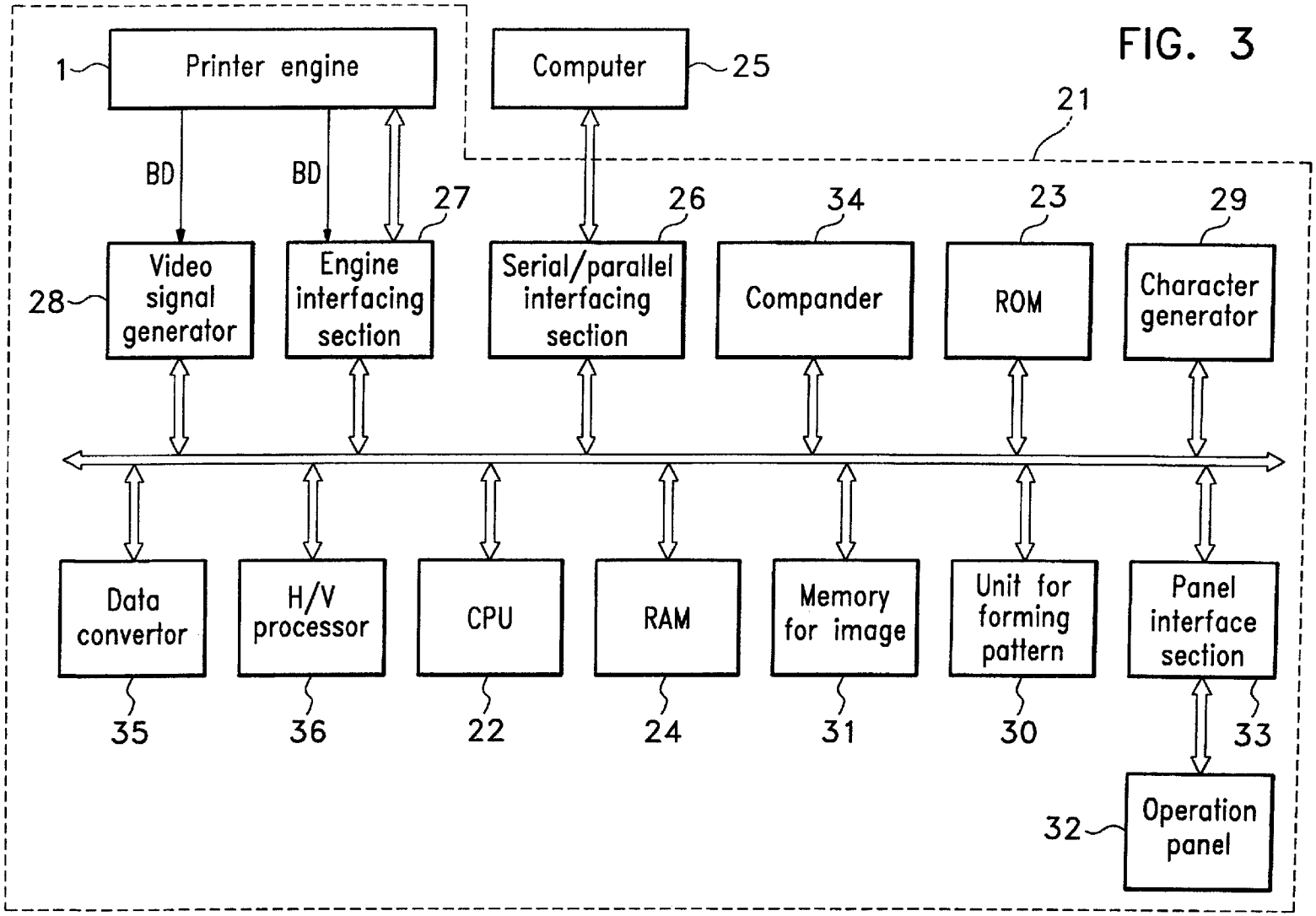
FIG. 3 is a block diagram of a color printer to which a method for removing pollution material which remain on the printer engine is applied, in accordance with the principles of the present invention.

Turn now to FIG. 3, which is a block diagram of a color printer to which a method for removing pollution material which remain on the printer engine is applied, in accordance with the principles of the present invention. The color printer 21 as shown in FIG. 3 includes a central processing unit (CPU) 22 for generally controlling the apparatus forming the color image according to a preferred program, a read only memory (ROM) 23 for storing a control program which is utilized for controlling the apparatus forming the color image, a random access memory (RAM) 24 which is an operation region of the central processing unit 22, and a serial or parallel interfacing section 26 allowing the color printer 21 to communicate with a computer 25 according to the control of the central processing unit 22.

The color printer 21 of FIG. 3 also includes an engine interfacing section 27 for interfacing information with a printer engine 1, a video signal generator 28 for processing image data to be printed according to the control of the central processing unit 22 in a form of signal so as to supply an electric signal to the light exposure device 4 (shown in FIG. 1) in the printer engine 1, a character generator 29 for generating a character pattern to coincide with a character code of text data transmitted from the computer 25, a pattern generator 30 for mixing and deploying the character pattern generated from the character generator 29 and the image data transmitted from the computer 25, an image memory 31 for storing the image data transmitted from the computer 25, an operation panel 32 on which a plurality of function keys are arranged for a user to select a function of the color printer 21. The operation panel 32 can include a display such as a liquid crystal display in order to convey information to a user.

In FIG. 3, the color printer 21 additionally includes a panel interfacing section 33 for interfacing an operation signal of the operation panel 32, and a compander 34 for compressing and extending the image data. In other words, the compander 34 compresses and expands the image data. The compander 34 is a device that improves the signal-to-noise ratio of reproduced or transmitted signals by compressing the range of amplitudes of the signals before transmission, and then expanding it on reproduction or reception. The color printer 21 also has a convertor 35 for converting the image data transmitted from the computer 25 into a dithering processed data or a binary data, and a horizontal/vertical (H/V) processor 36 for rotating the image data at a predetermined angle.

A typical color laser printer has four pure hues corresponding to four toner colors. There is a cyan toner container, a yellow toner container, a magenta toner container, and a black toner container (CYMK). A dithering process is available in some printers and allows those printers to form images with an apparent varying of intensities of colors. The apparent varying of intensities of the colors is sometimes desirable. In dithering, colors beyond the range of the four pure hues of the printer are rendered in patterns of primary colored dots. Instead of each printed dot representing a single pixel of an image, dithering uses a small array of dots to make a single pixel. These multiple dot pixels are often referred to as super-pixels. By varying the number of dots that actually get printed with a given color of ink in the super-pixel matrix, the printer can vary the perceived intensity of the color. Unfortunately, dithering degrades the perceived resolution of the color image. A printer able to print a black image with 600 dots per inch (dpi) resolution will not be able to print a dithered color image with 600 dots per inch resolution.

The serial/parallel interfacing section 26 receives the image data from the computer 25 through the parallel interfacing section, for example a centronic interface, or the serial interface section, for example a RS232C interface. In general, the serial interfacing section and parallel interfacing section are separately connected to the computer.

Figure 4:
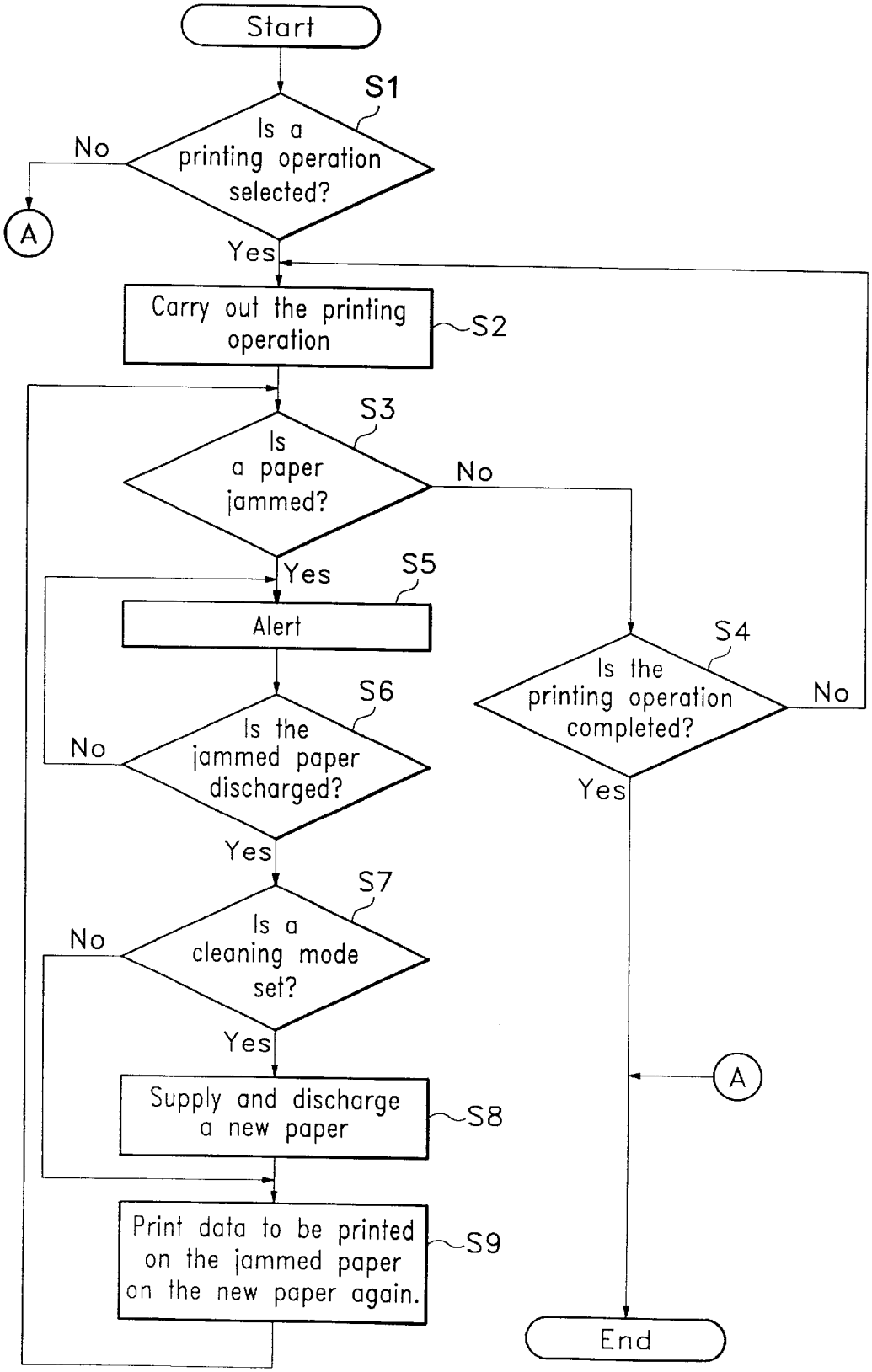
FIG. 4 is a flowchart showing a process of carrying out the method for removing the pollution material which remain on the printer engine, in accordance with the principles of the present invention.

Turn now to FIG. 4, which is a flowchart showing a process of carrying out the method for removing the pollution material which remain on the printer engine, in accordance with the principles of the present invention. Hereinafter, the operation of the apparatus for forming image in which the method according to the present invention is accomplished will be described in detail with reference to FIGS. 3 and 4.

The image data to be printed are transmitted through the serial/parallel interfacing section 26 to the color printer 21 so that the printing operation is performed. In FIG. 4, at step S1, when a user selects the printing operation, the computer 25 separates the image data according to colors, for example cyan, yellow, magenta, and black. Then, each of the image data separated according to the colors is transmitted to the color printer 21 in sequence.

The central processing unit 22 of the color printer 21 analyzes the image data corresponding to any color of different colors in the image data inputted through the serial/parallel interfacing section 26 according to a transmission way of the image data. Then, the character generator 29 converts the character code data into the character pattern. The converted character pattern and the image data corresponding to one of the colors are made to coincide with each other and deployed. The deployed image data are converted into the dithering processed data or the binary data by means of the data convertor 35 in a mode selected by the computer 25 or the user. The converted image data are compressed by the compander 34 and stored in the image memory 31.

In FIG. 4, at step S2, when all image data corresponding to one of the colors are stored in the image memory 31, the central processing unit 22 transmits the image data corresponding to one of the colors to the printer engine 1 and then instructs a start signal of the printing to the printer engine 1.

The printer engine 1 which receives the start signal of the printing from the central processing unit 22 outputs a line synchronization signal to the engine interfacing section 27. The central processing unit 22 receives the line synchronization signal from the engine interfacing section 27 and extends the signal stored in the image memory 31 by means of the compander 34 according to the line synchronization signal. Then, the central processing unit 22 outputs the signal extended by the compander 34 to the video signal generator 28. The video signal generator 28 outputs video data to drive the light exposure device 4. Accordingly, the printing operation is carried out.

As a process of carrying out the printing operation will be described below, a paper supplying device (not shown) supplies a paper 11 by means of a pick-up roller thereof. The supplied paper 11 is attached on the surface of the dielectric sheet 10 of the image transmitting device 7 under the electrification voltage of the electrification roller 15. At this time, the electrification device 3 electrifies the surface of the photosensitive device 2 which rotates in the electric potential and the light exposure device 4 such as the laser diode scans the light carrying the image data corresponding to one of the colors, for example the yellow color, by predetermined periods. Accordingly, the electrostatic latent image having one of the colors is formed on the photosensitive body of the photosensitive device 2. The plurality of the toner containers 5*a,* 5*b,* 5*c,* and 5*d* are carried in sequence by the turret of the developer 5 so as to be opposite to the surface of the photosensitive device 2. The electrostatic latent image which is formed on the surface of the photosensitive device 2 is covered with the toner contained in one of the toner containers 5*a,* 5*b,* 5*c,* and 5*d* to be developed.

The toner image which is presented by the toner contained in one of the toner containers 5*a,* is 5*b,* 5*c,* and 5*d* is rotated at a position to be opposite to the image transmitting drum 8 of the image transmitting device 7 while the photosensitive device 2 rotates. The toner image which is rotated at the position to be opposite to the image transmitting drum 8 is transmitted to the recording paper 11 attached to the dielectric sheet of the image transmitting drum 8 under the image transmitting voltage which is applied to the image transmitting cylinder 9.

The toner which remains on the surface of the photosensitive device 2 is removed by the first cleaning device 6. Then, the photosensitive device 2 finishes the operation of printing image data having one of the colors and prepares to print image data having another color of the colors.

In FIG. 4, at step S3, the central processing unit 22 checks whether or not the paper 11 is jammed. When it is determined that the paper 11 is not jammed in step S3, then the step S4 is performed next. At step S4, the central processing unit 22 checks whether or not the printing operation is completed. When it is determined that the printing operation is completed, the central processing unit 22 finishes all processes. However, when it is determined that the printing operation is not completed, the central processing unit 22 returns the printing operation to the step S2 and repeatedly carries out the steps after the step S2. The process of printing the color image data as described above is applied to other colors, for examples the cyan and black.

In FIG. 4, when it is determined that the paper 11 is jammed in step S3, then the step S5 is performed next. At step S5, the central processing unit 22 alerts a user that the paper 11 is jammed by giving a predetermined alarm. The alarm can be an audible alarm or a visible alarm or both. The alarm can correspond to any means of alerting a user. The alarm can begin when the paper jam is detected. The alarm can continue until the jammed paper 11 is removed from the printer 21. Or the alarm can continue for a predetermined time after the paper jam is detected. Or the alarm can begin as a visible and audible alarm when the paper jam is first detected, and then continue as only a visible alarm until the jammed paper 11 is removed from the printer 21. Other means of alerting a user to the existence of the paper jam may be used.

In FIG. 4, at step S6, a determination is made as to whether the jammed paper 11 has been removed from the color printer 21. When it is determined that the jammed paper 11 has been removed from the printer 21, then step S7 is performed next. However, when it is determined that the jammed paper 11 has not yet been removed from the printer 21, the central processing unit 22 returns the printing operation to the step S5 and repeatedly carries out the steps after the step S5.

In FIG. 4, at step S7, when the jammed paper 11 is removed from the color printer 21, a determination as to whether the user set a cleaning mode. If the cleaning mode is deemed to be set in the step S7, then step S8 is performed next. At step S8, a second sheet of paper is enforcedly supplied to the printer 21, a contamination removal process is performed, and then the second sheet of paper is discharged from the printer 21. In other words, at step S8, a second sheet of paper is provided to the printer 21, a pollution material removal process is performed, and then the second sheet of paper is discharged from the printer 21.

At step S9, after step S8 has been performed, a third sheet of paper is supplied to the printer 21 and then print data that was originally intended to be printed on the jammed paper 11 is printed onto the third sheet of paper. Then the printing operation returns to step S3 so that the steps after the step S3 are carried out repeatedly.

At step S8, after the second sheet of paper is supplied to the printer 21, a contamination removal process is performed, and then the second sheet of paper is discharged from the printer 21. In the aforementioned contamination removal process, the contamination that exists in the printer 21 is fixed to the second sheet of paper. The contamination that exists in the printer 21 can be located in the vicinity of the image transmitting drum 8. At step S8, the operation of fixing the contaminants to the second sheet of paper is carried out by a fixing device 16 without printing the image data on the second sheet of paper. Accordingly, the contaminants and pollution material which remains on the developing device 5, the fixing device 16, and the photosensitive device 7 is fixed to the second sheet of paper and removed from the printer engine 1. Preferably, the second sheet of paper is supplied to and discharged from the printer engine 1 without the image data being printed on the second sheet of paper in order to carry out the more effective cleaning mode.

If the cleaning mode is deemed to be not set in the step S7, then step S9 is performed next and step S8 is not performed. Thus, when the cleaning mode is deemed to be not set in step S7, the step S9 causes the print data originally intended to be printed on the jammed paper 11 to be printed onto a sheet of paper newly supplied to the printer 21. Then the printing operation returns to step S3 so that the steps after the step S3 are carried out repeatedly.

With respect to setting the cleaning mode, the cleaning mode can be set at the time of starting the printing operation, at the time that the paper 11 is jammed, at the time of powering on the printer 21, or at any intervening time.

If the cleaning mode is set by the user, therefore, the contaminants and pollution material remaining in the printer engine 1 can be removed from the printer engine 1 automatically after the jammed paper 11 is discharged from the printer engine 1.

Although the method for removing the pollution material from the apparatus making the image according to the present invention are described with respect to a color printer, it will be understood that the method according to the present invention may be applied to a monochrome printer. In addition, the principles of the present invention may be applied to a color copier, a monochrome copier, a color facsimile machine, or a monochrome facsimile machine. In fact, the principles of the present invention may be applied to any image forming apparatus where contaminants/pollution material, for example toner, can remain inside the apparatus after a paper jam occurs. Also, the principles of the present invention may be applied to an image forming apparatus where contaminants/pollution material, for example toner, can remain inside the apparatus after an error occurs.

As described above, according to the method of removing the pollution material from the printer engine of the present invention, if the paper is jammed, the printer removes the jammed paper therefrom automatically and carries out a warming-up to prepare the printing operation. Then, the new paper is enforcedly supplied to the printer engine so that the pollution material such as toner is removed from the printer engine in such a manner to fix the pollution material to the new paper without printing data on the new paper. Accordingly, there is an advantage in that an optimum quality of printing can be accomplished without a waste of toner.

The sheet of paper that receives the pollution material can be a blank sheet of paper whereas the jammed sheet of paper can be a sheet of paper having a business letterhead. In other words, some special printing operations involve special recording media such as colored paper, paper including a business letterhead, paper having several adhesive sections for the printing of address labels, clear plastic transparencies, paper utilized to receive data corresponding to a combination of financial data along with a paycheck which includes a perforation and also includes special security markings for the paycheck, and other types of special recording media. When such a special printing operation is performed, it can be convenient to use a standard blank page of paper to receive the pollution material instead of using the special recording media needed for the special printing operation. Accordingly, the principles of the present invention apply to a use of a blank sheet of paper to receive the pollution material regardless of the type of paper used to receive the print data, wherein the print data corresponds to the desired data and the pollution material corresponds to undesirable contaminants.

For example, let us suppose that a user is printing images onto transparencies in order to prepare for a presentation during which the transparencies will be used with an overhead projector to convey information to a large gathering of people. A transparency is a clear plastic sheet that is 8.5 inches by 11 inches in size. This type of transparency is more expensive than a plain blank sheet of paper having the same size. Let us suppose that one of the transparencies becomes jammed in the printer during the print operation. The user then removes the jammed transparency and discards it. Then the user will not want to waste a transparency by having a transparency receive the pollution material.

Thus, a first embodiment of the present invention has an special alarm that indicates that the user should insert one sheet of blank paper instead of a transparency. This special alarm can include text such as "insert blank sheet of paper" displayed on a liquid crystal display at the operation panel 32 in FIG. 3.

A second embodiment of the present invention applies to a printer having two cassettes for recording media. A first cassette is filled with transparencies by the user. A second cassette is filled with blank sheets of paper by the user. The printing operation uses the first cassette to print the data onto the transparencies under normal conditions. When a jam occurs, the pollution material is automatically printed onto a blank sheet of paper automatically taken from the second cassette. The printer automatically takes the recording medium from the second cassette only for pollution material. Then the printer would resume taking the recording medium from the first cassette after the pollution material was removed from the printer.

The foregoing paragraphs describe the details of a method for removing pollution material which remain on an engine of an image forming apparatus, and more particularly to a method for removing pollution material which remain on an engine of an image forming apparatus, in which it is possible to automatically remove pollution material such as toner that remain in the image forming apparatus so that an optimum quality of printing is maintained without a waste of toner.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A method comprising:

determining whether a first recording medium is jammed in an image forming apparatus during a printing operation;

when said first recording medium is jammed in said apparatus during said printing operation, determining whether said first recording medium is removed from said apparatus; and when said first recording medium is removed from said apparatus, supplying a second recording medium to said apparatus and transferring pollution material of said apparatus to said second recording medium and then ejecting said second recording medium from said apparatus.

2. The method of claim 1, wherein said image forming apparatus is a unit selected from the group consisting of a printer, a copier, and a facsimile system.

3. The method of claim 1, wherein said pollution material of said apparatus corresponds to toner remaining in said apparatus after said first recording medium is removed from said apparatus.

4. The method of claim 1, wherein said transferring of said pollution material of said apparatus to said second recording medium further comprises heating said pollution material on said second recording medium by a fixing heater of a fixing device of said apparatus to fix said pollution material onto said second recording medium.

5. The method of claim 4, wherein said pollution material corresponds to toner remaining in said apparatus after said first recording medium is removed from said apparatus.

6. The method of claim 4, wherein said pollution material corresponds to toner remaining at a printer engine of said apparatus after said first recording medium is removed from said apparatus.

7. The method of claim 1, further comprising generating an alarm when said first recording medium becomes jammed in said apparatus.

8. The method of claim 7, wherein said generating of said alarm further comprises:

generating an audible alarm for a predetermined quantity of time; and generating a visible alarm until said first recording medium is removed from said apparatus.

9. A method comprising:

receiving a first recording medium into an image forming apparatus;

performing a first printing operation to form a first image onto said first recording medium;

determining whether said first recording medium is jammed in said apparatus;

when said first recording medium is jammed in said apparatus, determining whether said first recording medium is removed from said apparatus;

when said first recording medium is removed from said apparatus, receiving a second recording medium into said apparatus, transferring pollution material of said apparatus to said second recording medium, and then ejecting said second medium and said pollution material from said apparatus;

receiving a third recording medium into said apparatus; and performing a second printing operation to form said first image onto said third recording medium, and then ejecting said third recording medium.

10. The method of claim 9, said pollution material remaining in said apparatus at a first location after the jammed first recording medium is removed from said apparatus, wherein said pollution material located at said first location will degrade a quality of an appearance of said first image formed on a subsequently provided recording medium unless said pollution material is removed from said first location.

11. The method of claim 10, wherein said transferring of said pollution material of said apparatus to said second recording medium further comprises heating said pollution material on said second recording medium by a fixing heater of a fixing device of said apparatus to fix said pollution material onto said second recording medium.

12. The method of claim 10, wherein said transferring of said pollution material to said second recording medium does not completely form said first image onto said second recording medium.

13. The method of claim 9, wherein said performing of said first printing operation to form said first image onto said first recording medium further comprises:

receiving first image data from a host computer to said apparatus;

storing said first image data in a memory unit of said apparatus;

emitting a laser beam corresponding to at least a part of said first image data to form an electrostatic latent image corresponding to at least a part of said first image data on a photosensitive drum of said apparatus; and attaching a first quantity of toner to said electrostatic latent image on said photosensitive drum.

14. The method of claim 13, wherein said first recording medium becomes jammed in said apparatus after said first quantity of toner is attached to said electrostatic latent image on said photosensitive drum.

15. The method of claim 14, wherein said pollution material corresponds to said first quantity of toner.

16. The method of claim 15, wherein said transferring of said pollution material of said apparatus to said second recording medium does not include emitting a laser beam.

17. A method comprising:

determining whether a first recording medium is jammed in an image forming apparatus during a first printing operation;

when said first recording medium is jammed in said apparatus during said first printing operation, determining whether said first recording medium is removed from said apparatus;

when said first recording medium is removed from said apparatus, performing a pollution removal operation by supplying a second recording medium to said apparatus and transferring pollution material from a first location in said apparatus to said second recording medium and then removing said second medium and said pollution material from said apparatus; and said pollution material corresponding to a material remaining at said first location after the jammed first recording medium is removed from said apparatus, wherein said pollution material located at said first location will cause a degradation in a quality of a second printing operation unless said pollution material is removed from said first location prior to performing said second printing operation.

18. The method of claim 17, further comprising determining whether a cleaning mode is set before performing said pollution removal operation.

19. The method of claim 18, wherein said pollution removal operation is performed only when said cleaning mode is set.

20. The method of claim 19, wherein said pollution removal operation is performed to remove said pollution material from said first location in said apparatus, and then said second printing operation is performed to form said first image onto a new recording medium, said new recording medium being newly supplied to said apparatus after said second recording medium is removed from said apparatus.

21. The method of claim 20, wherein said first recording medium corresponds to a first transparency, said second medium corresponds to a blank sheet of paper, and said new recording medium corresponds to a second transparency.

22. The method of claim 19, wherein said second recording medium corresponds to a blank sheet of paper.

23. The method of claim 19, wherein said pollution removal operation transfers said pollution material to said second recording medium and does not form said first image on said second recording medium.

* * * * *